US007612633B2

(12) United States Patent
Hangai et al.

(10) Patent No.: US 7,612,633 B2
(45) Date of Patent: Nov. 3, 2009

(54) HIGH-FREQUENCY SWITCH

(75) Inventors: Masatake Hangai, Tokyo (JP); Yukinobu Tarui, Tokyo (JP); Tamotsu Nishino, Tokyo (JP); Yoshitsugu Yamamoto, Tokyo (JP); Moriyasu Miyazaki, Tokyo (JP); Yoji Isota, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 204 days.

(21) Appl. No.: 11/748,852

(22) Filed: May 15, 2007

(65) Prior Publication Data

US 2008/0106353 A1 May 8, 2008

(30) Foreign Application Priority Data

Nov. 7, 2006 (JP) ..... 2006-301556

(51) Int. Cl.
*H01P 1/10* (2006.01)
*H01P 1/15* (2006.01)

(52) U.S. Cl. ..... 333/101; 333/104

(58) Field of Classification Search ..... 333/101, 333/103, 104, 107, 108
See application file for complete search history.

(56) References Cited

U.S. PATENT DOCUMENTS 4,897,563 A * 1/1990 Bahl ..... 326/13
5,159,297 A * 10/1992 Tateno ..... 333/104
5,193,218 A * 3/1993 Shimo ..... 333/104
6,693,498 B1 * 2/2004 Sasabata et al. ..... 333/103

OTHER PUBLICATIONS

Val Kaper, et al. "Monolithic AlGaN/GaN HEMT SPDT switch" IEEE 12th GAAS Symposium, 2004, pp. 83-86.

* cited by examiner

*Primary Examiner*—Dean O Takaoka
(74) *Attorney, Agent, or Firm*—Oblon, Spivak, McClelland, Maier & Neustadt, L.L.P.

(57) ABSTRACT

The present invention provides a high-frequency switch including: a first switching element connected between a first input/output terminal and a second input/output terminal; a second switching element connected between the second input/output terminal and the first switching element; a high-frequency line provided between the first input/output terminal, the first switching element, and a third input/output terminal; and a third switching element connected between the third input/output terminal, the high-frequency line, and a ground. By connecting the first switching element, the second switching element, the high-frequency line, and the third switching element, because there exists no FET through which a large current flows when a state between the first input/output terminal and the third input/output terminal is set to a transmission state which requires high power handling capability, there is no need to use an FET having a large gate width, which is effective in reducing a loss of the switch.

12 Claims, 6 Drawing Sheets

HIGH-FREQUENCY SWITCH

BACKGROUND OF THE INVENTION

1. Field of the Invention

The present invention relates to a high-frequency switch which can be provided with high power handling capability, with a low loss, and at low costs.

2. Description of the Related Art

As an example of a high-frequency switch, FIG. 10 shows a circuit diagram of a high-frequency switch disclosed in "Monolithic AlGaN/GaN HEMT SPDT switch" IEEE 12$^{th}$ GaAs Symposium, pp. 83-86, 2004. The circuit is a double-pole single-throw switch in which field effect transistors (hereinafter, referred to as "FET") connected in series with an output terminal COM are connected to two sets of an FET connected in parallel and an input terminal. In the circuit, by applying a voltage to control signal terminals V1 and V2, FETs Q1 to Q4 are caused to have a transmission property or an isolation property, whereby a path of a high-frequency signal is switched. Further, the circuit has characteristics in which power handling capability of the switch can be increased by an increase of each gate width of the FET Q1 and FET Q2 that are connected in series with each other and by an increase of each saturation current.

However, when the switch having high power handling capability is configured with the above-mentioned configuration, there arises a problem in that a transmission loss at an input of low power is increased as each gate width of the FETs connected in series with each other is increased in order to increase the power handling capability. For example, in FIG. 10, in a case where the high power handling capability is required so as to obtain a transmission state between an IN1 and the COM, it is necessary to increase the gate width of the FET Q1. However, the FET having a large gate width generally has a low isolation property. Accordingly, when the gate width of the FET Q1 is increased, a state between the IN1 and the COM is set to an isolation state, and a high-frequency signal from an IN2 leaks into the IN1 side when a state between the IN2 and the COM is set to the transmission state. As a result, the transmission loss between the IN2 and the COM is increased. The circuit has a symmetric configuration, so a similar problem also arises when the high power handling capability is required between the IN2 and the COM.

SUMMARY OF THE INVENTION

According to the present invention, there is provided a high-frequency switch including:

a first input/output terminal;

a first switching element having one end connected to the first input/output terminal;

a second switching element having one end connected to the other end of the first switching element;

a first ground connected to the other end of the second switching element;

a second input/output terminal connected to the other end of the first switching element;

a high-frequency line having one end connected to the first input/output terminal;

a third switching element having one end connected to the other end of the high-frequency line;

a second ground connected to the other end of the third switching element; and a third input/output terminal connected to the other end of the high-frequency line.

According to the present invention, the high-frequency line is provided in place of the FET between the first input/output terminal and the third input/output terminal. Accordingly, in a case where a state between the first input/output terminal and the third input/output terminal is set to a transmission state and high power handling capability is required, there exists no FET through which a large current flows. As a result, there is no need to provide an FET having a large gate width, which is effective in reducing a loss of the high-frequency switch.

BRIEF DESCRIPTION OF THE DRAWINGS

In the accompanying drawings:

FIG. 3 is an equivalent circuit diagram in a case where the first FET and the third FET shown in FIG. 1 are turned off and the second FET is turned on;

FIG. 7 is an equivalent circuit diagram in a case where the first FETs and the third FETs shown in FIG. 5 are turned off and the second FET is turned on;

DESCRIPTION OF THE PREFERRED EMBODIMENTS

First Embodiment

Figure 1:
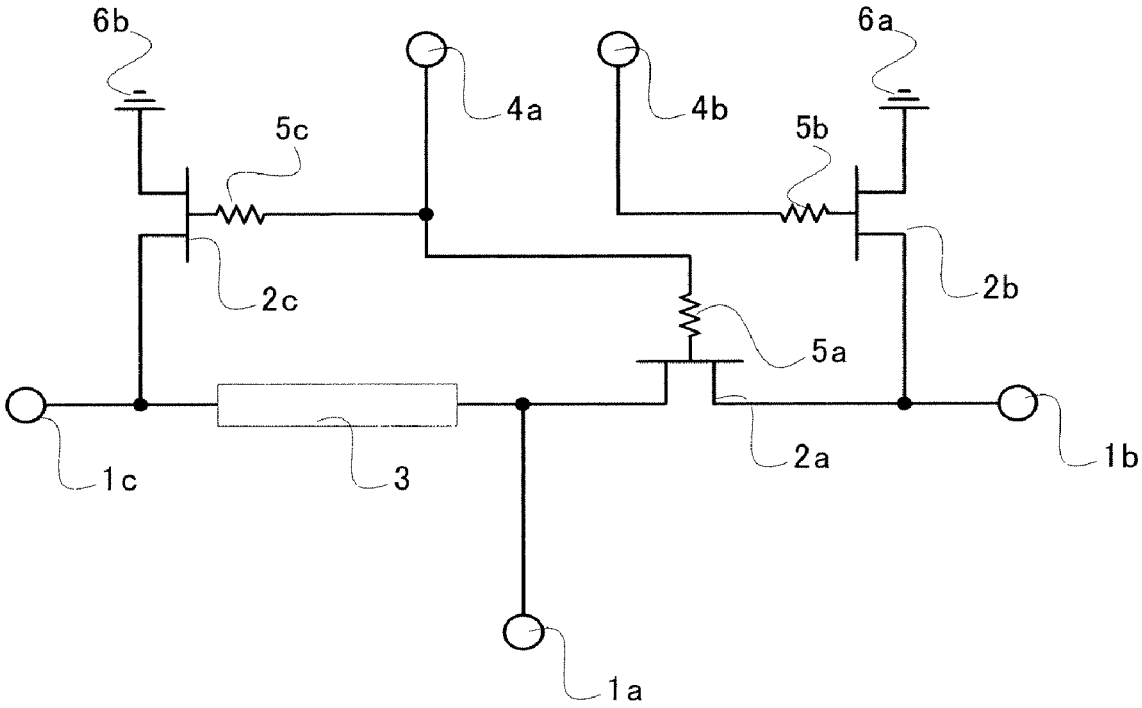
FIG. 1 is a circuit diagram showing a configuration of a high-frequency switch according to a first embodiment of the present invention.

FIG. 1 is a circuit diagram showing a configuration of a high-frequency switch according to a first embodiment of the present invention. The high-frequency switch includes a first input/output terminal 1*a*, a second input/output terminal 1*b*, a third input/output terminal 1*c*, a first FET 2*a*, a second FET 2*b*, a third FET 2*c*, a high-frequency line 3, a first control signal terminal 4*a*, a second control signal terminal 4*b*, a first resistor 5*a*, a second resistor 5*b*, a third resistor 5*c*, a first ground 6*a*, and a second ground 6*b*.

In this embodiment, assuming that an electric length of the high-frequency line 3 is set to ¼ wavelength of an operating frequency, impedance of the first input/output terminal 1*a* is represented as Z1*a*, impedance of the third input/output terminal 1*c* is represented as Z1*c*, and impedance of the high-frequency line 3 is represented as Z3, the following formula is established.

$$Z1a=Z1c=Z3$$

Further, assuming that a saturation current which flows to the first FET 2*a* is represented as I2*a*, a saturation current which flows to the second FET 2*b* is represented as I2*a*, and a saturation current which flows to the third FET 2*c* is represented as I2*c*, the following formula is established.

$$I2c=I2a=I2b$$

First, an operation of the FET will be described.

The FET is turned on when a voltage equivalent to a drain voltage or a source voltage is applied to the control signal terminal, which can be assumed as an equivalent resistor at a high frequency (hereinafter, referred to as "on-resistance"). On the other hand, when a DC signal having a voltage level of equal to or lower than a pinch-off voltage is applied to the control signal terminal, the FET is turned off, which can be assumed as an equivalent capacitor at a high frequency (hereinafter, referred to as "off-capacitance").

Next, an operation of the high-frequency switch according to the first embodiment of the present invention will be described.

Figure 2:
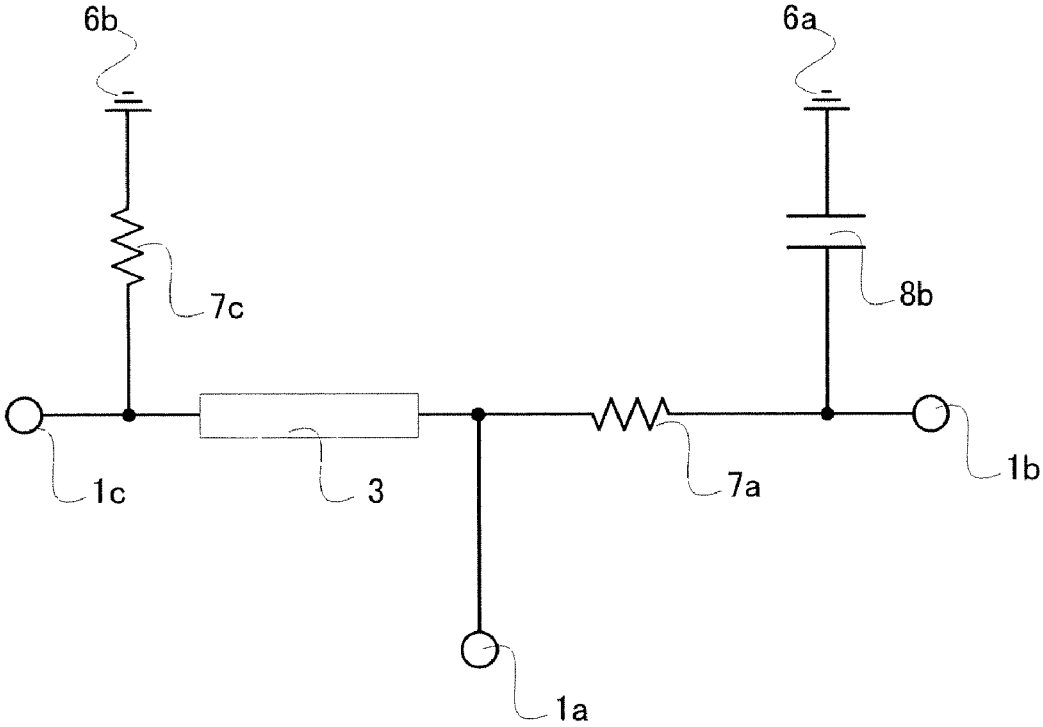
FIG. 2 is an equivalent circuit diagram in a case where a first FET and a third FET shown in FIG. 1 are turned on and a second FET is turned off.

FIG. 2 shows an equivalent circuit in a case where the first FET 2*a* and the third FET 2*c* are turned on and the second FET 2*b* is turned off. In FIG. 2, reference symbol 7*a* denotes an on-resistance of the first FET 2*a*; 7*c*, an on-resistance of the third FET 2*c*; and 8*b*, an off-capacitance of the second FET 2*b*. In this case, a state between the first input/output terminal 1*a* and the second input/output terminal 1*b* becomes a transmission state, and a state between the first input/output terminal 1*a* and the third input/output terminal 1*c* becomes an isolation state.

Figure 3:
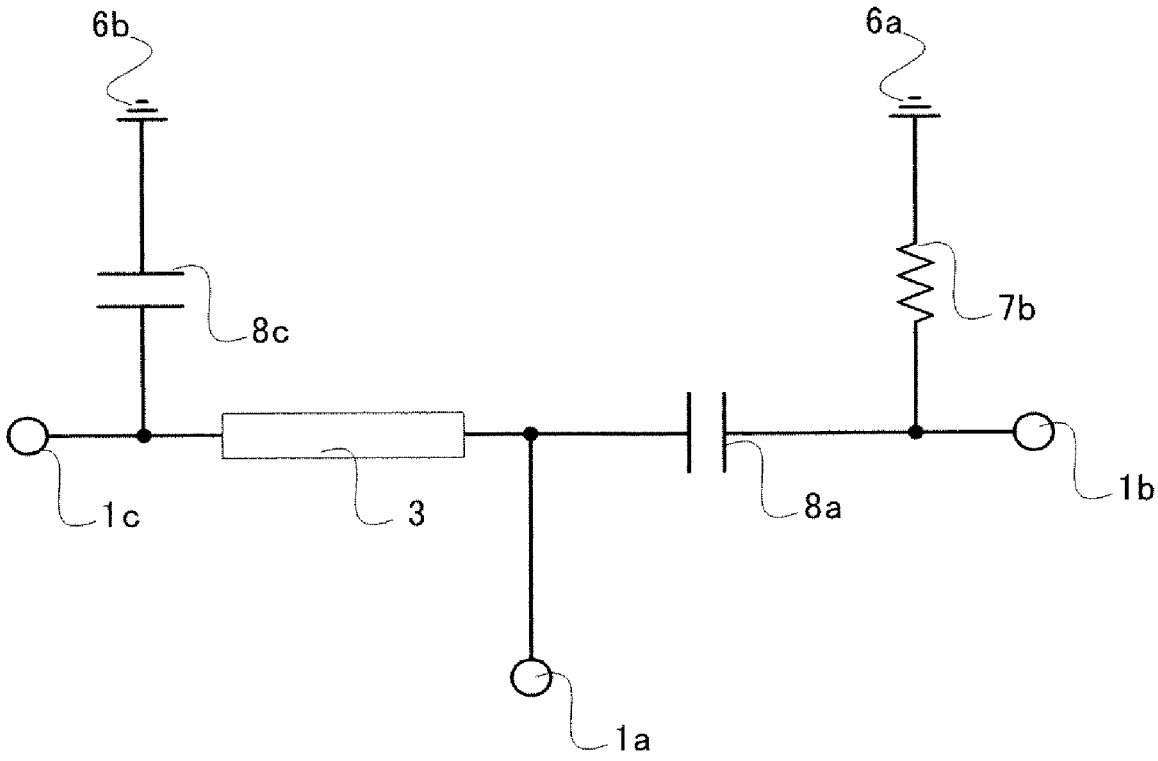

FIG. 3 shows an equivalent circuit in a case where the first FET 2*a* and the third FET 2*c* are turned off and the second FET 2*b* is turned on. In FIG. 3, reference symbol 8*a* denotes an off-capacitance of the first FET 2*a*; 8*c*, an off-capacitance of the third FET 2*c*; and 7*b*, an on-resistance of the second FET 2*b*. In this case, a state between the first input/output terminal 1*a* and the second input/output terminal 1*b* becomes the isolation state, and a state between the first input/output terminal 1*a* and the third input/output terminal 1*c* becomes the transmission state.

According to the first embodiment of the present invention, in a case where the high power handling capability is required when the state between the first input/output terminal 1*a* and the third input/output terminal 1*c* is set to the transmission state, there exists no FET through which a large current flows. As a result, there is no need to use an FET having a large gate width, which is effective in reducing a loss of the high-frequency switch.

Further, since the electric length of the high-frequency line 3 is set to ¼ wavelength of the operating frequency, when the state between the first input/output terminal 1*a* and the second input/output terminal 1*b* is set to the transmission state and the state between the first input/output terminal 1*a* and the third input/output terminal 1*c* is set to the isolation state, high-frequency signals which leak from the first input/output terminal 1*a* into the third input/output terminal 1*c* can be reduced, thereby improving the isolation property.

In addition, a relationship among the impedance Z1*a* of the first input/output terminal 1*a*, the impedance Z1*c* of the third input/output terminal 1*c*, and the impedance Z3 of the high-frequency line 3 is made to satisfy the following equation.

$$Z1a=Z1c=Z3$$

Accordingly, an impedance matching property of the high-frequency circuit can be obtained, which is effective in increasing the power handling capability and reducing the loss.

Figure 4:
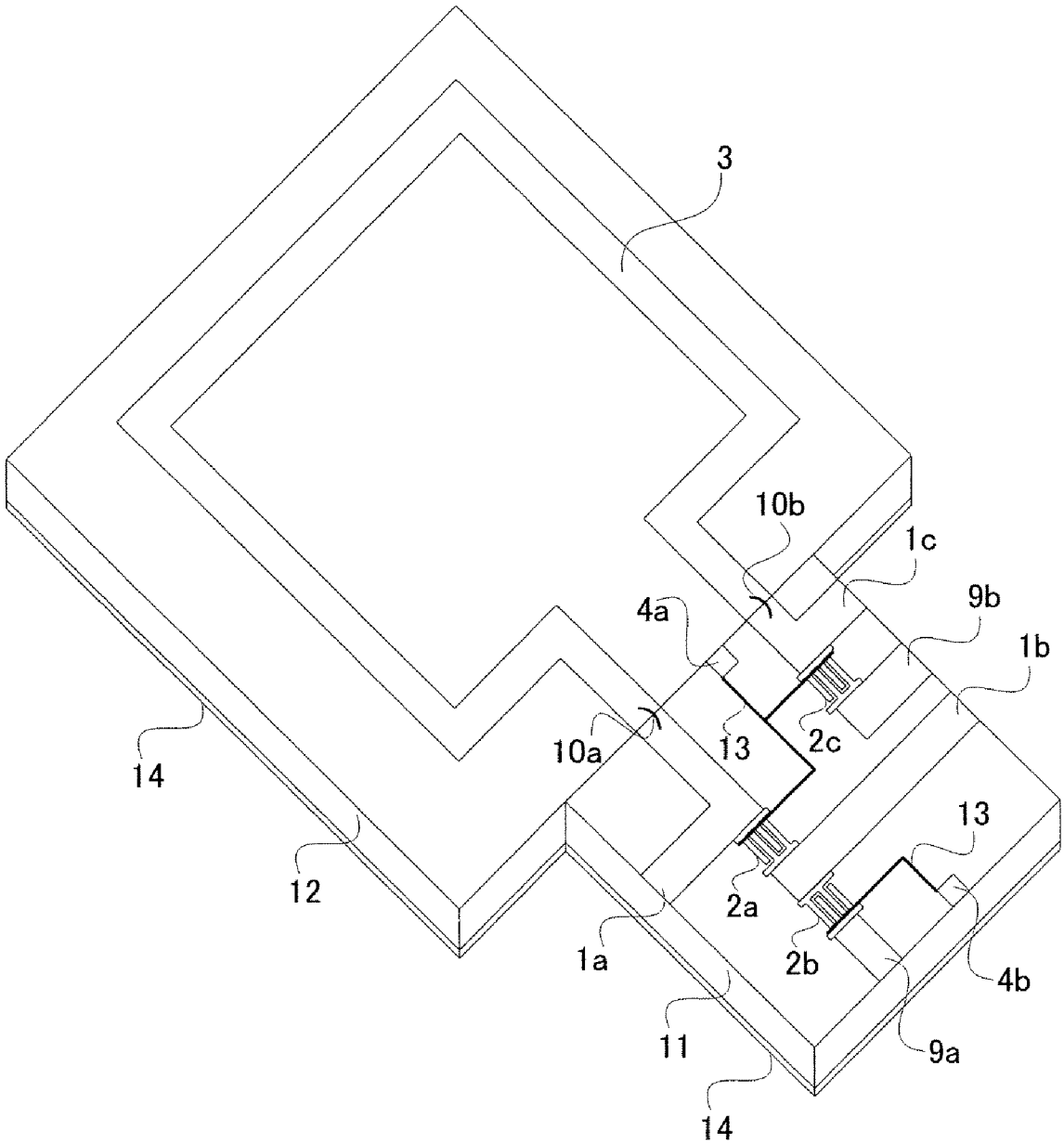
FIG. 4 is perspective view showing an appearance of a configuration of the high-frequency switch of FIG. 1.

FIG. 4 is perspective view showing an appearance of a configuration in which the high-frequency switch shown in FIG. 1 is formed on a substrate. In FIG. 4, reference symbols 9*a* and 9*b* denote ground terminals; 10*a* and 10*b*, wires; 11, a semiconductor substrate; 12, a dielectric substrate; 13, a bias line; and 14, ground.

In FIG. 4, the high-frequency line 3 having a large occupation area is formed on the dielectric substrate 12 produced at a low cost, and components other than the high-frequency line 3 are formed on the semiconductor substrate 11. The high-frequency line 3 formed on the dielectric substrate 12, and the first input/output terminal 1*a* and the third input/output terminal 1*c* that are formed on the semiconductor substrate 11 are connected to each other via the wires 10*a* and 10*b*. With this configuration, an area for the semiconductor substrate 11 can be reduced, which is effective in reducing costs of the high-frequency switch.

In the above embodiment, the electric length of the high-frequency line is set to ¼ wavelength of the operating frequency, and the relationship among the impedance Z1*a* of the first input/output terminal 1*a*, the impedance Z1*c* of the third input/output terminal 1*c*, and the impedance Z3 of the high-frequency line 3 is made to satisfy the following equation.

$$Z1a=Z1c=Z3$$

However, even when the electric length of the high-frequency line is set to ¼ wavelength of the necessary frequency, and the relationship among the impedance Z1*a* of the first input/output terminal 1*a*, the impedance Z1*c* of the third input/output terminal 1*c*, and the impedance Z3 of the high-frequency line 3 is made to satisfy the following equation $$Z1c=2\times Z1a,$$

$$Z3=\sqrt{2}\times Z1a,$$

the impedance matching property of the high-frequency circuit can be obtained, and the same effect can be achieved.

Second Embodiment

Figure 5:
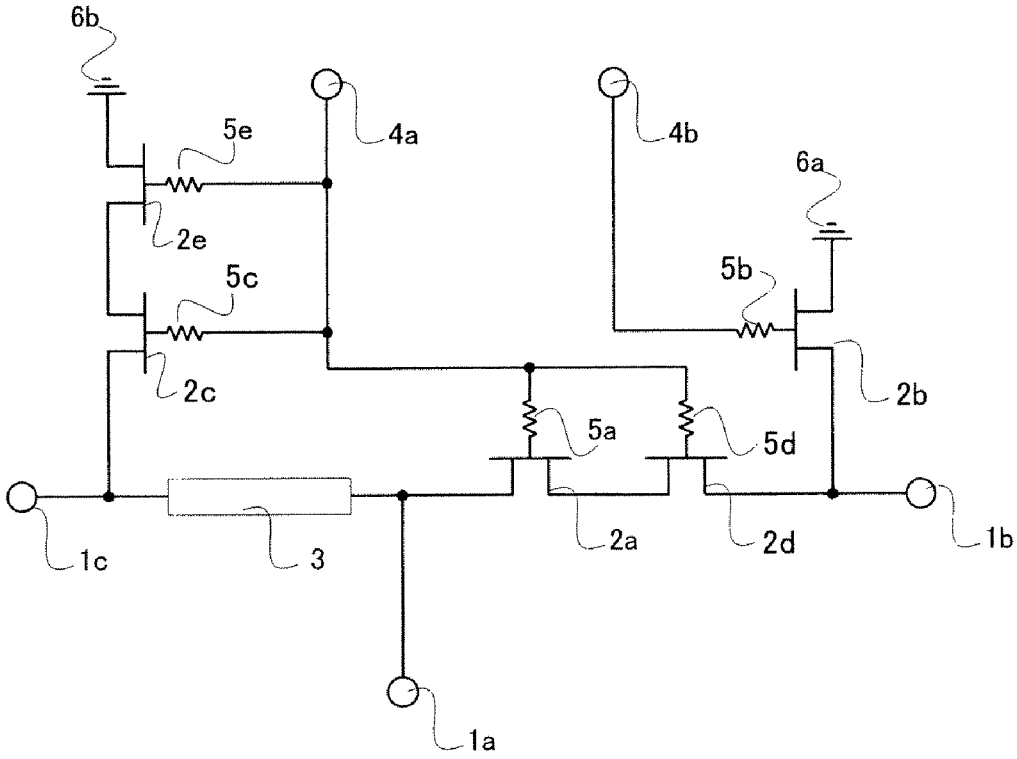
FIG. 5 is a circuit diagram showing a configuration of a high-frequency switch according to a second embodiment of the present invention.

FIG. 5 is a diagram showing a configuration of a high-frequency switch according to a second embodiment of the present invention. The high-frequency switch includes a first input/output terminal 1*a*, a second input/output terminal 1*b*, a third input/output terminal 1*c*, first FETs 2*a* and 2*d* cascade-connected with each other, a second FET 2*b*, third FETs 2*c* and 2*e* cascade-connected with each other, a high-frequency line 3, a first control signal terminal 4*a*, a second control signal terminal 4*b*, a first resistor 5*a*, a second resistor 5*b*, a third resistor 5*c*, a fourth resistor 5*d*, a fifth resistor 5*e*, a first ground 6*a*, and a second ground 6*b*.

Next, an operation of the high-frequency switch according to the second embodiment of the present invention will be described.

Figure 6:
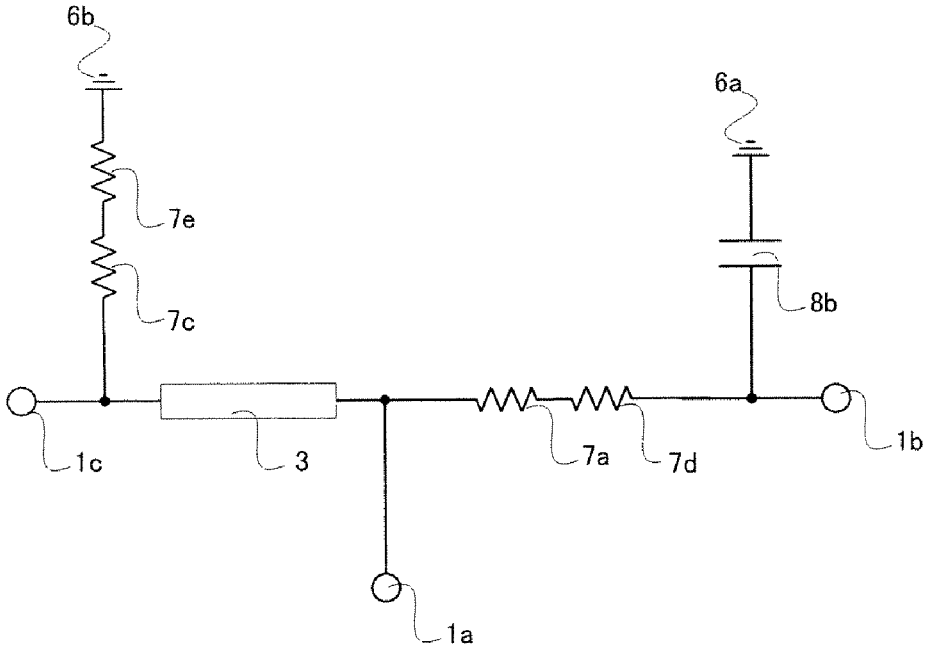
FIG. 6 is an equivalent circuit diagram in a case where first FETs and third FETs shown in FIG. 5 are turned on and a second FET is turned off.

FIG. 6 is an equivalent circuit in a case where the first FETs 2*a* and 2*d* cascade-connected with each other and the third FETs 2*c* and 2*e* cascade-connected with each other are turned on and the second FET 2*b* is turned off. In FIG. 6, reference symbols 7*a* and 7*d* denote on-resistances of the first FETs 2*a* and 2*d* cascade-connected with each other; 7*c* and 7*e*, on-resistances of the third FETs 2*c* and 2*e* cascade-connected with each other; and 8*b*, an off-capacitance of the second FET 2*b*. In this case, a state between the first input/output terminal 1*a* and the second input/output terminal 1*b* becomes a transmission state, and a state between the first input/output terminal 1*a* and the third input/output terminal 1*c* becomes an isolation state.

Figure 7:
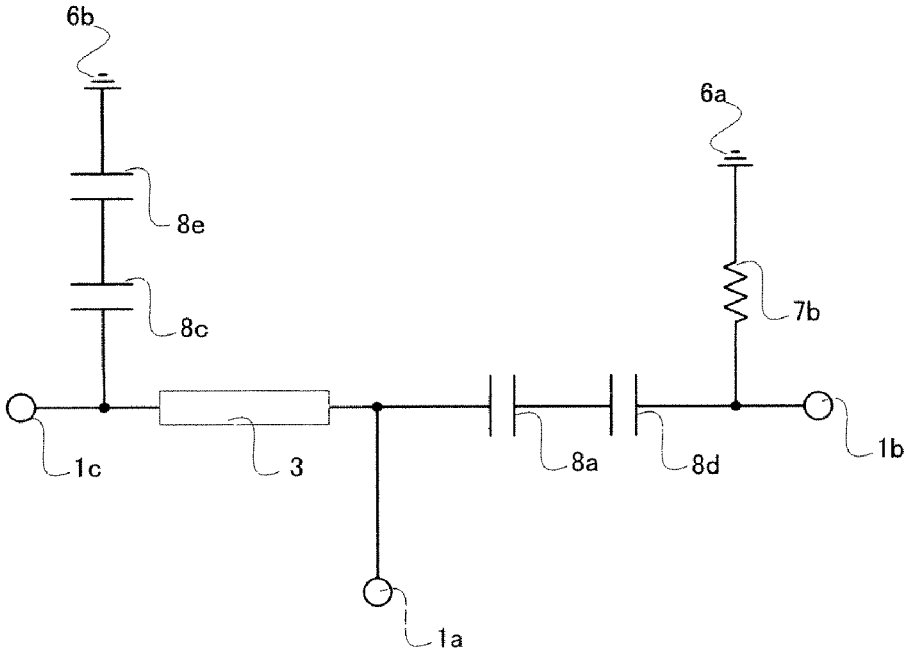

FIG. 7 is an equivalent circuit in a case where the first FETs 2*a* and 2*d* cascade-connected with each other and the third FETs 2*c* and 2*e* cascade-connected with each other are turned off and the second FET 2*b* is turned on. Reference symbols 8*a* and 8*d* denote off-capacitances of the first FETs 2*a* and 2*d* cascade-connected with each other; 8*c* and 8*e*, off-capacitances of the third FETs 2*c* and 2*e* cascade-connected with each other; and 7*b*, an on-resistance of the second FET 2*b*. In this case, a state between the first input/output terminal 1*a* and the second input/output terminal 1*b* becomes the isolation state, and a state between the first input/output terminal 1*a* and the third input/output terminal 1*c* becomes the transmission state.

According to the second embodiment of the present invention, in a case where the high power handling capability is required when the state between the first input/output terminal 1*a* and the second input/output terminal 1*b* is set to the transmission state, there exists no FET through which a large current flows. As a result, there is no need to use an FET having a large gate width, which is effective in reducing the loss of the high-frequency switch. In addition, while a high voltage is applied to each of the first FETs and the third FETs, because a plurality of FETs are cascade-connected with each other, the voltage is distributed, thereby making it possible to reduce the voltage applied to each FET. In the second embodiment, the case where the number of cascade-connections is two has been described. Alternatively, by increasing the number of connections, it is possible to increase the effect of reducing the voltage due to the distribution of the voltage.

Third Embodiment

Figure 8:
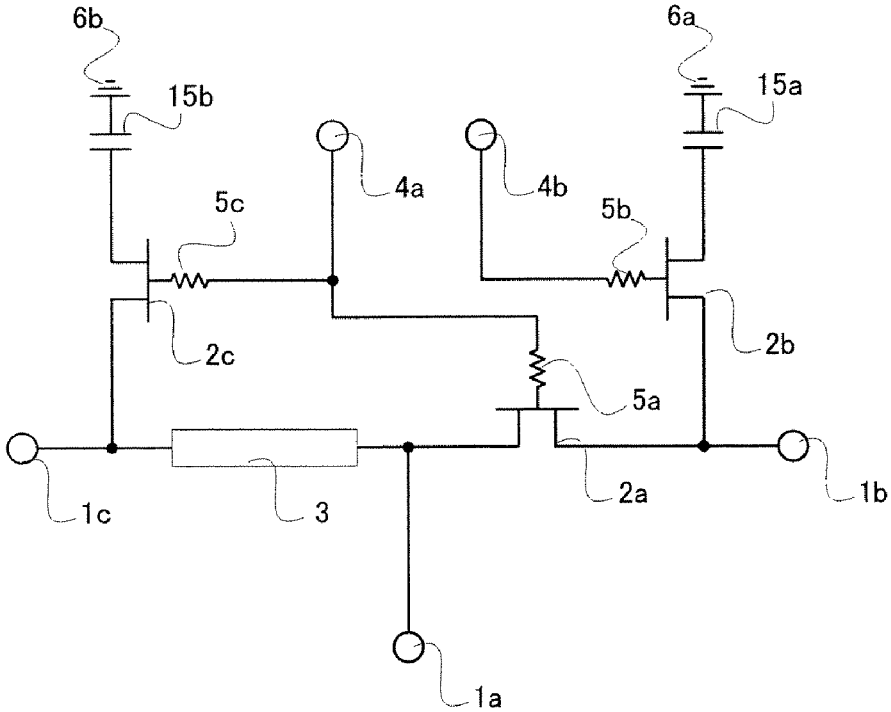
FIG. 8 is a circuit diagram showing a configuration of a high-frequency switch according to a third embodiment of the present invention.

FIG. 8 is a diagram showing a configuration of a high-frequency switch according to a third embodiment of the present invention. Series capacitors 15*a* and 15*b* are respectively provided between a first ground 6*a* and a second FET 2*b* and between the second ground 6*b* and a third FET 2*c*.

According to the third embodiment of the present invention, parasitic inductance between the switching elements and the grounds, that is, between the first ground 6*a* and the second FET 2*b* and between the second ground 6*b* and the third FET 2*c*, and the series capacitors 15*a* and 15*b* resonate in series with each other. As a result, the parasitic inductance can be removed, which is effective in reducing the loss of the high-frequency switch and increasing the isolation property.

Fourth Embodiment

Figure 9:
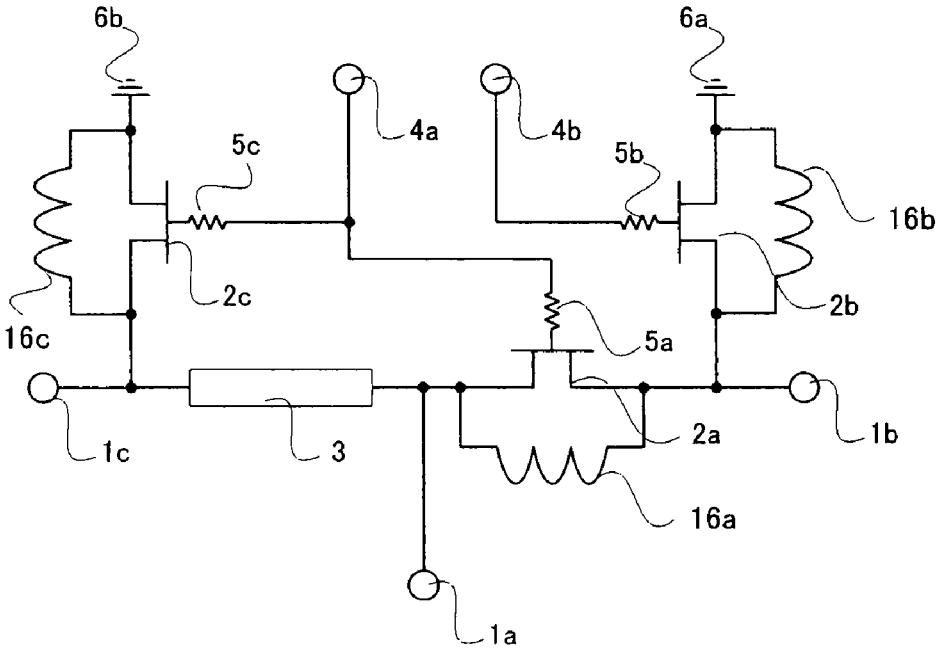
FIG. 9 is a circuit diagram showing a configuration of a high-frequency switch according to a fourth embodiment of the present invention.
Figure 10:
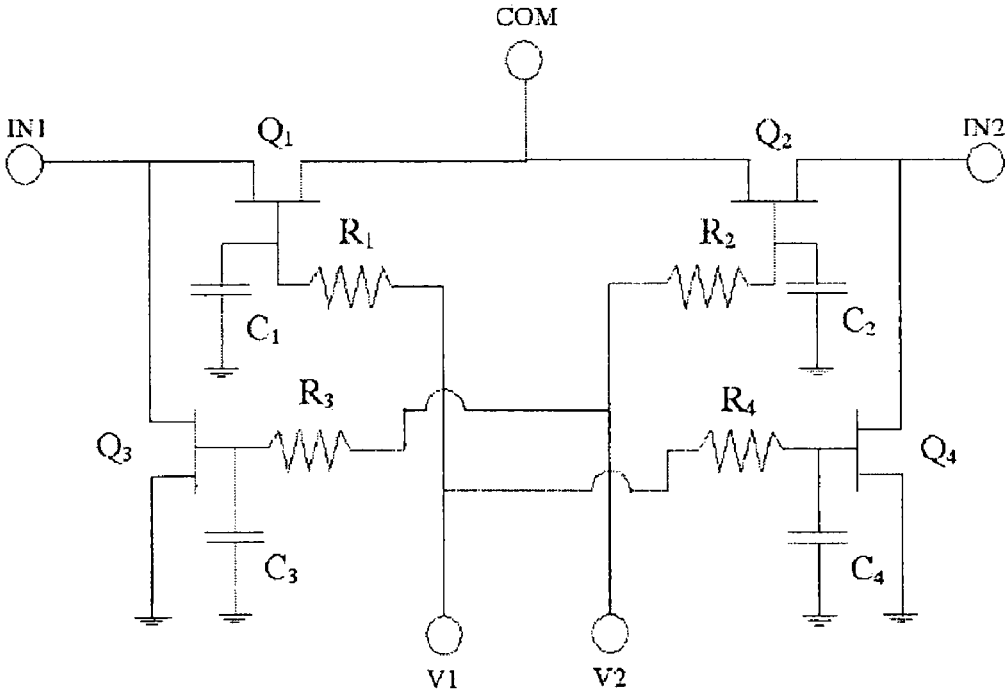
F I G. 10 BACKGROUND ART
FIG. 10 is a circuit diagram of a conventional high-frequency switch.

FIG. 9 is a diagram showing a configuration of a high-frequency switch according to a fourth embodiment of the present invention. Parallel inductors 16*a*, 16*b*, and 16*c* are connected in parallel with a first FET 2*a*, a second FET 2*b*, and a third FET 2*c*, respectively.

According to the fourth embodiment of the present invention, the off-capacitance provided by the switching element resonates in parallel with the parallel inductors connected in parallel with the switching elements. As a result, it is possible to increase the isolation property at the time when the switching element is turned off, which is effective in reducing the loss of the high-frequency switch and increasing the isolation property.

Further, in each embodiment, the case where the FETs are each used as a switching element has been described. Alternatively, a PIN diode, a varactor diode, or an MEMS switch may be used as the switching element.

Also in the second to fourth embodiments, in the same manner as in the first embodiment, a high-frequency line having a large occupation area is formed on a dielectric substrate produced at a low cost, and components other than the high-frequency line are formed on a semiconductor substrate. The high-frequency line formed on the dielectric substrate, and a first input/output terminal and a third input/output terminal that are formed on the semiconductor substrate are connected to each other via wires. With this configuration, an area for the semiconductor substrate can be reduced, which is effective in reducing costs of the high-frequency switch.

Further, also in the second to fourth embodiments, in the same manner as in the first embodiment, when the electric length of the high-frequency line is set to ¼ wavelength of the operating frequency, and the relationship among the impedance Z1*a* of the first input/output terminal 1*a*, the impedance Z1*c* of the third input/output terminal 1*c*, and the impedance Z3 of the high-frequency line 3 is set to satisfy the following formula $$Z1a=Z1c=Z3$$

or $$Z1c=2\times Z1a,$$

$$Z3=\sqrt{2}\times Z1a,$$

the impedance matching property of the high-frequency circuit can be obtained, which is effective in increasing the power handling capability and reducing the loss.

According to the present invention, a high-frequency switch with a low loss and high power handling capability can be achieved. Therefore, in a case where the present invention is applied to an antenna of radio communication equipment, the antenna can be used with a low loss and large power.

What is claimed is:

1. A high-frequency switch, comprising:

a first input/output terminal;

a first switching element having one end connected to the first input/output terminal;

a second switching element having one end connected to the other end of the first switching element;

a first ground connected to the other end of the second switching element;

a second input/output terminal connected to the other end of the first switching element;

a high-frequency line having one end connected to the first input/output terminal;

a third switching element having one end connected to the other end of the high-frequency line;

a second ground connected to the other end of the third switching element; and a third input/output terminal connected to the other end of the high-frequency line, wherein the high-frequency line is formed on a dielectric substrate; and components other than the high-frequency line are formed on a semiconductor substrate.

2. A high-frequency switch according to claim 1, wherein:

the first switching element, the second switching element, and the third switching element each comprise a field effect transistor; and the field effect transistors each have a saturation current set to satisfy the following relationship:

(the third switching element)≧(the first switching element)≧(the second switching element).

3. A high-frequency switch according to claim 1, wherein the first switching element and the third switching element each have a plurality of switching elements cascade-connected with each other.

4. A high-frequency switch according to any one of claims 1 to 3, wherein at least one of the first ground and the second ground comprises a series capacitor.

5. A high-frequency switch according to any one of claims 1 to 3, wherein at least one of the first switching element, the second switching element, and the third switching element comprises a parallel inductor.

6. A high-frequency switch according to claim 1, wherein:

the high-frequency line has an electric length set to ¼ wavelength of an operating frequency; and impedance values are set such that impedance of the first input/output terminal, impedance of the third input/output terminal, and impedance of the high-frequency line are set to be equal to each other.

7. A high-frequency switch according to claim 1, wherein:

the high-frequency line has an electric length set to ¼ wavelength of an operating frequency; and impedance values are set such that impedance of the third input/output terminal is twice as large as impedance of the first input/output terminal, and impedance of the high-frequency line is $\sqrt{2}$ times as large as the impedance of the first input/output terminal.

8. A high-frequency switch according to claim 1, wherein:

the components other than the high-frequency line include the first input/output terminal, the first switching element, the second switching element, the first ground, the second input/output terminal, the third switching element, the second ground, and the third input/output terminal.

9. A high-frequency switch according to claim 1, wherein:

the high-frequency line formed on the dielectric substrate is loop-shaped.

10. A high-frequency switch according to claim 9, further comprising:

a first wire that connects the first input/output terminal to the one end of the high-frequency line; and a second wire that connects the third input/output terminal to the other end of the high-frequency line.

11. A high-frequency switch according to claim 1, wherein:

the first input/output terminal is directly connected to the one end of the high-frequency line and the one end of the first switching element, the third input/output terminal is directly connected to the other end of the high-frequency line and the one end of the third switching element, and the second input/output terminal is directly connected to the other end of the first switching element and to the one end of the second switching element.

12. A high-frequency switch, comprising:

a first input/output terminal;

a first switching element having one end connected to the first input/output terminal;

a second switching element having one end connected to the other end of the first switching element;

a first ground connected to the other end of the second switching element;

a second input/output terminal connected to the other end of the first switching element;

only one high-frequency line, the high-frequency line having one end connected to the first input/output terminal;

a third switching element having one end connected to the other end of the high-frequency line;

a second ground connected to the other end of the third switching element; and a third input/output terminal connected to the other end of the high-frequency line.

* * * * *